US008002261B2

(12) United States Patent
Hirose et al.

(10) Patent No.: US 8,002,261 B2
(45) Date of Patent: Aug. 23, 2011

(54) FEEDING METHOD, FEEDING DEVICE, AND IMAGE FORMING SYSTEM

(75) Inventors: Yuichi Hirose, Kanagawa (JP); Takayuki Nishimura, Tokyo (JP); Hideaki Matsui, Kanagawa (JP); Masaru Yamagishi, Kanagawa (JP); Takashi Fukumoto, Miyagi (JP)

(73) Assignee: Ricoh Company, Limted, Tokyo (JP)

( * ) Notice: Subject to any disclaimer, the term of this patent is extended or adjusted under 35 U.S.C. 154(b) by 313 days.

(21) Appl. No.: 12/230,833

(22) Filed: Sep. 5, 2008

(65) Prior Publication Data

US 2009/0066008 A1 Mar. 12, 2009

(30) Foreign Application Priority Data

Sep. 7, 2007 (JP) ..... 2007-232496
Oct. 23, 2007 (JP) ..... 2007-274653
Jun. 5, 2008 (JP) ..... 2008-148545

(51) Int. Cl.
*B65H 3/44* (2006.01)

(52) U.S. Cl. ..... 271/9.02; 271/9.04; 271/97

(58) Field of Classification Search ..... 271/9.04, 271/9.02, 9.01, 97, 98
See application file for complete search history.

(56) References Cited

U.S. PATENT DOCUMENTS 5,130,750 A * 7/1992 Rabb ..... 399/364
2006/0214352 A1* 9/2006 Clark ..... 271/9.01
2008/0224378 A1* 9/2008 Shibuya ..... 270/1.01

FOREIGN PATENT DOCUMENTS

JP 05286590 A * 11/1993
JP 2001-354331 12/2001
JP 10-316262 9/2003
JP 2006-264917 10/2006

OTHER PUBLICATIONS

English language Abstract for JP 3475716 dated Dec. 12, 1998.

* cited by examiner

*Primary Examiner* — Stefanos Karmis
*Assistant Examiner* — Ernesto Suarez
(74) *Attorney, Agent, or Firm* — Harness, Dickey & Pierce, P.L.C.

(57) ABSTRACT

A starting unit starts, in parallel with a blowing operation for a first tray, a blowing operation for a second tray that is to perform a feeding operation next. When a predetermined time elapses after starting the blowing operation for the second tray, a feeding unit switches from the first tray to the second tray, and feeds the recording medium from the second tray. When the blowing operation is performed for a number of trays before switching the trays and the number of trays is equal to or larger than a predetermined number, a control unit limits the number of trays for performing the blowing operation.

17 Claims, 6 Drawing Sheets

FEEDING METHOD, FEEDING DEVICE, AND IMAGE FORMING SYSTEM

CROSS-REFERENCE TO RELATED APPLICATIONS

The present application claims priority to and incorporates by reference the entire contents of Japanese priority document 2007-232496 filed in Japan on Sep. 7, 2007, Japanese priority document 2007-274653 filed in Japan on Oct. 23, 2007 and Japanese priority document 2008-148545 filed in Japan on Jun. 5, 2008.

BACKGROUND OF THE INVENTION

1. Field of the Invention

The present invention relates to a technology for feeding a recording medium from a stack of recording media one by one.

2. Description of the Related Art

In recent years, to meet various needs of customers, there has been an increasing demand for image forming by using a recording medium having high adhesiveness, such as a coated paper, an art paper, or a film sheet. However, because it is not easy to separate the sheets having high adhesiveness from one another, if a conventional feeding method using a separating claw, a separating pad, and a feed and reverse roller (FRR) is used for feeding the sheets from a sheet tray, plural sheets may be fed from the sheet tray at one time, or no sheet may be fed from the sheet tray.

To solve the above problem, in a conventional feeding device, air is blown to upper side portions of a pile of sheets stacked on a sheet tray to separate the sheets from one another, and then the sheets are fed from the sheet tray one by one (hereinafter, such a process is referred to as "air-separation feeding process"). To perform the air-separation feeding process, air inlets are arranged on side fences of a sheet tray, and the air is blown from blower fans through the air inlets to both sides of the pile of the sheets (hereinafter, referred to as "blowing operation" as appropriate). Thus, the stacked sheets are separated from one another and the sheets are then fed from the sheet tray one by one (see, for example, Japanese Patent Application Laid-open No. 2001-354331 and Japanese Patent Application Laid-open No. 2006-264917).

In Japanese Patent No. 3475716, a feeding method is disclosed in which plural sheet trays are arranged, and if it is detected that the number of sheets stacked on the current sheet tray that currently performs a feeding operation is less than a predetermined number, an air supplying unit of the next sheet tray is activated. Then, if it is detected that there is no sheets in the current sheet tray when a predetermined time elapses after the air supplying unit is activated, the next sheet tray is set to the current sheet tray, so that the next sheet tray continues to perform the feeding operation.

It has been required to perform an image forming process on a large number of sheets at a high speed. To meet such a requirement, a conventional image forming apparatus includes a plurality of sheet trays, and performs a feeding operation by switching over the sheet trays from one to another.

If the number of sheet trays is increased to feed a large number of sheets, an operation of controlling the sheet trays becomes complicated. For example, if the image forming apparatus includes two sheet trays, one is set to the current sheet tray that currently performs the feeding operation, and the other is set to the next sheet tray that will continue to perform the feeding operation next to the current sheet tray.

However, if the image forming apparatus includes three or more sheet trays, the next sheet tray cannot be easily determined from among the sheet trays other than a sheet tray that is set to the current sheet tray.

Furthermore, a conventional image forming apparatus includes multiple control units (processors), and the control units operate in conjunction with each other. The same control unit is not necessarily used to determine a sheet tray from which a sheet is fed, to control a feeding operation and a conveying operation of a sheet tray, and to control the air-separation feeding process. Therefore, in some cases, the control unit has to control the air supply operation without having any information about the next sheet tray.

In such a case, it is possible that the air supply operation is started in advance in all of the sheet trays. However, if all air supplying units of the sheet trays are driven, electric-power consumption is increased. Furthermore, in some cases, sufficient electric power cannot be obtained for driving all the air supplying units depending on a capacity of a power source circuit.

SUMMARY OF THE INVENTION

It is an object of the present invention to at least partially solve the problems in the conventional technology.

According to an aspect of the present invention, there is provided a method of feeding a recording medium to an image forming apparatus by a feeding device that includes a blowing unit that blows air to a stack of recording media and a plurality of trays each configured to contain the stack of recording media. The method includes starting, in parallel with a blowing operation for a first tray that is a current feeding tray currently performing a feeding operation, a blowing operation for a second tray that is a next feeding tray to perform the feeding operation next to the first tray; feeding including, when a predetermined time elapses after starting the blowing operation for the second tray, switching the current feeding tray from the first tray to the second tray, and feeding the recording medium from the second tray; and controlling including, when the blowing operation is performed for a number of trays before switching the current feeding tray from the first tray to the second tray, determining whether the number of trays for which the blowing operation is being performed is equal to or larger than a predetermined number, and limiting the blowing operation based on a result of determination at the determining.

Furthermore according to another aspect of the present invention, there is provided a device for feeding a recording medium to an image forming apparatus. The device includes a blowing unit that blows air to a stack of recording media; a plurality of trays each configured to contain the stack of recording media; a starting unit that starts, in parallel with a blowing operation for a first tray that is a current feeding tray currently performing a feeding operation, a blowing operation for a second tray that is a next feeding tray to perform the feeding operation next to the first tray; a feeding unit, when a predetermined time elapses after starting the blowing operation for the second tray, switches the current feeding tray from the first tray to the second tray, and feeds the recording medium from the second tray; and a control unit that, when the blowing operation is performed for a number of trays before switching the current feeding tray from the first tray to the second tray, determines whether the number of trays for which the blowing operation is being performed is equal to or larger than a predetermined number, and limits the blowing operation based on a result of determination.

Moreover, according to still another aspect of the present invention, there is provided an image forming system including an image forming apparatus that forms an image on a recording medium; and a feeding device that feeds the recording medium to the image forming apparatus. The feeding device includes a blowing unit that blows air to a stack of recording media; a plurality of trays each configured to contain the stack of recording media; a starting unit that starts, in parallel with a blowing operation for a first tray that is a current feeding tray currently performing a feeding operation, a blowing operation for a second tray that is a next feeding tray to perform the feeding operation next to the first tray; a feeding unit, when a predetermined time elapses after starting the blowing operation for the second tray, switches the current feeding tray from the first tray to the second tray, and feeds the recording medium from the second tray; and a control unit that, when the blowing operation is performed for a number of trays before switching the current feeding tray from the first tray to the second tray, determines whether the number of trays for which the blowing operation is being performed is equal to or larger than a predetermined number, and limits the blowing operation based on a result of determination.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
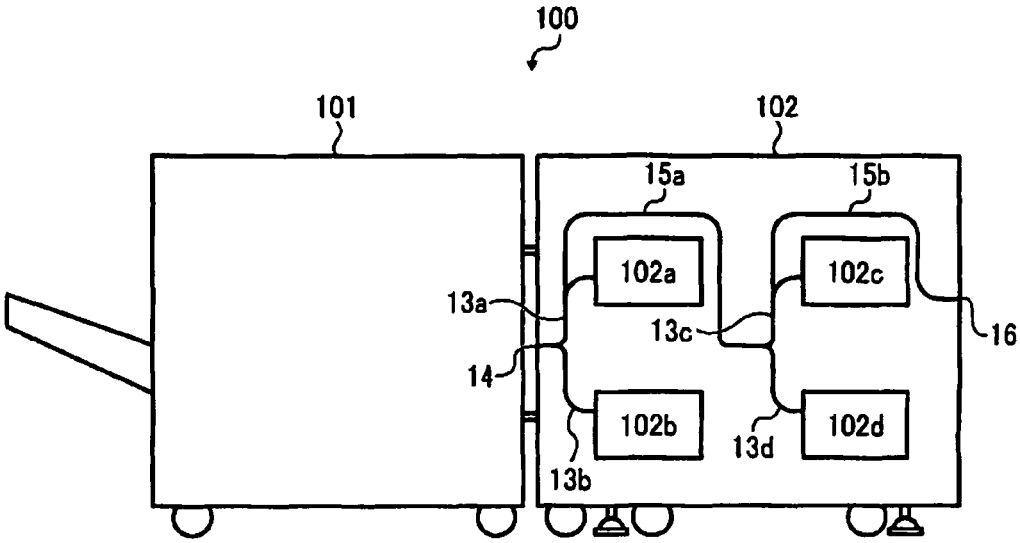
FIG. 1 is a schematic diagram of an image forming system including a sheet feeding device according to an embodiment of the present invention.
Figure 11:
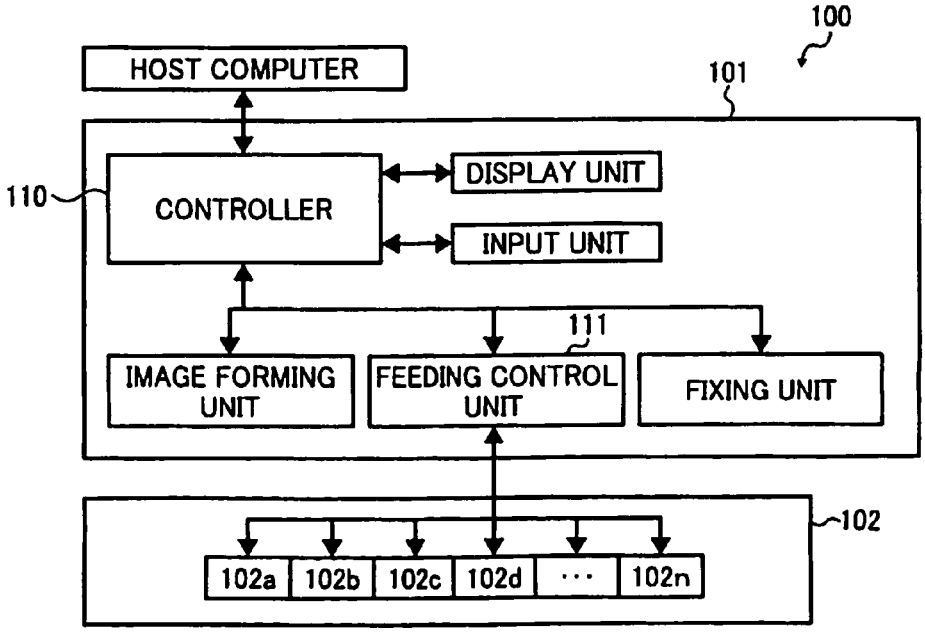
FIG. 11 is a block diagram of the image forming system shown in FIG. 1.

FIG. 1 is a schematic diagram of an image forming system 100 including a sheet feeding device 102 according to an embodiment of the present invention. FIG. 11 is a block diagram of the image forming system 100.

As shown in FIG. 1, the image forming system 100 includes an image forming apparatus 101 and the sheet feeding device 102. The sheet feeding device 102 includes sheet trays 102*a*, 102*b*, 102*c*, and 102*d*. The image forming apparatus 101 is, for example, a copy machine, a printer, a facsimile, or a multifunction product (MFP) employing an electrophotographic system or an inkjet system. The sheet feeding device 102 is connected to the image forming apparatus 101, and feeds a recording medium (hereinafter, "sheet") to the image forming apparatus 101.

The image forming apparatus 101 performs image forming on a sheet supplied by the sheet feeding device 102 by a well-known process, such as an electrophotographic process or an inkjet process. An explanation of the specific configuration of the image forming apparatus 101 is omitted because it is not an essential part of the present invention.

As shown in FIG. 11, the image forming apparatus 101 includes a controller 110 and a feeding control unit 111. The controller 110 controls an image forming operation performed by the image forming apparatus 101, and determines a sheet tray from which a sheet is to be fed. The controller 110 sends an instruction to the feeding control unit 111 as to which sheet tray is to feed a sheet for each print job. Upon receiving the instruction from the controller 110, the feeding control unit 111 causes the sheet tray specified by the instruction to feed a sheet, and controls the air-separation feeding process for the sheet tray. Specifically, the feeding control unit 111 sends a control signal to each of the sheet trays 102*a*, 102*b*, 102*c*, and 102*d* to control operation of a feeding roller 23 (see FIG. 2) and a blowing operation.

Each of the sheet trays 102*a*, 102*b*, 102*c*, and 102*d* contains a stack of sheets on which images are to be formed by the image forming apparatus 101. A sheet stacked on each of the sheet trays 102*a*, 102*b*, 102*c*, and 102*d* is fed to the image forming apparatus 101 through a conveying path 13.

The conveying path 13 includes a conveying path 13*a* for conveying a sheet from the sheet tray 102*a*, a conveying path 13*b* for conveying a sheet from the sheet tray 102*b*, a conveying path 13*c* for conveying a sheet from the sheet tray 102*c*, and a conveying path 13*d* for conveying a sheet from the sheet tray 102*d*. The conveying path 13*a* and the conveying path 13*b* are joined together to be connected to a conveying path, and the conveying path is connected to a feeding opening 14. The feeding opening 14 is connected to the image forming apparatus 101. Thus, a sheet is conveyed from the sheet feeding device 102 to the image forming apparatus 101 through the feeding opening 14.

The conveying path 13*c* and the conveying path 13*d* are joined together to be connected to a conveying path 15*a*. The conveying path 15*a* then passes by the sheet trays 102*a* and 102*b*, and is connected to the conveying path 13*a*. With this configuration, a sheet stacked in each of the sheet trays 102*a*, 102*b*, 102*c*, and 102*d* can be fed to the image forming apparatus 101.

One sheet feeding device 102 is connectable to another sheet feeding device 102, and thereby a plurality of sheet feeding devices 102 is connectable to the image forming apparatus 101 in a serial manner. For such a configuration, the sheet feeding device 102 includes a feeding opening 16 to receive a sheet from another sheet feeding device 102 located downward. A sheet fed through the feeding opening 16 is conveyed to the conveying path 13*c* through a conveying path 15*b*, and then conveyed to the conveying path 13*a* through the conveying path 15*a*. Then, the sheet is fed to the image forming apparatus 101 through the feeding opening 14.

Figure 2:
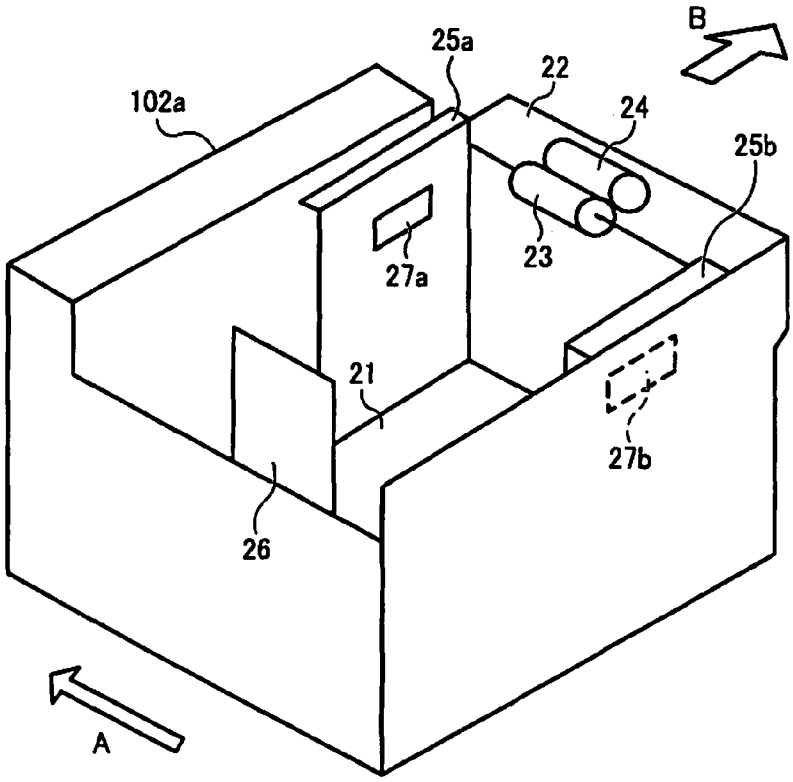
FIG. 2 is a perspective view of a sheet tray included in the sheet feeding device shown in FIG. 1.

FIG. 2 is a perspective view of the sheet tray 102*a*. The sheet tray 102*a* is pulled out from the sheet feeding device 102 in a direction indicated by an arrow A in FIG. 2 (direction vertical to the sheet surface on which FIG. 1 is printed). The configurations of the sheet trays 102*b*, 102*c*, and 102*d* are the same as that of the sheet tray 102*a*.

The sheet tray 102*a* includes a bottom plate 21 on which a pile of sheets is stacked, and a feeding unit 22 that picks up the uppermost sheet from the pile stacked on the bottom plate 21 one by one, and feeds the picked-up sheet toward the image forming apparatus 101.

The feeding unit 22 includes the feeding roller 23 and a separating roller 24. Each of the feeding roller 23 and the separating roller 24 is driven at a predetermined feeding timing. The uppermost sheet is separated from the pile stacked on the bottom plate 21 in accordance with rotations of the feeding roller 23 and the separating roller 24, is pulled out in a direction indicated by an arrow B in FIG. 2, and is then fed to the conveying path 13*a*.

The sheet tray 102*a* includes a pair of side fences 25*a* and 25*b*. The side fences 25*a* and 25*b* align both sides of the pile stacked on the bottom plate 21 in a width direction (in a direction perpendicular to a feeding direction) of the sheet. Furthermore, the sheet tray 102*a* includes an end fence 26. The end fence 26 aligns the rear end of the pile stacked on the bottom plate 21.

Air inlets 27*a* and 27*b* are formed on the side fences 25*a* and 25*b*, respectively. The air inlets 27*a* and 27*b* are arranged to blow air to both sides of the pile stacked on the bottom plate 21. A fan 29 (see FIG. 3) is arranged on the outside of each of the side fences 25*a* and 25*b*. Outside air flows into the sheet tray 102*a* through each of the air inlets 27*a* and 27*b* by rotation of the fan 29. The air flows from both sides of the pile stacked on the bottom plate 21, and the sheets in the upper portion of the pile float in the air, so that the sheets can be separated from one another.

Figure 3:
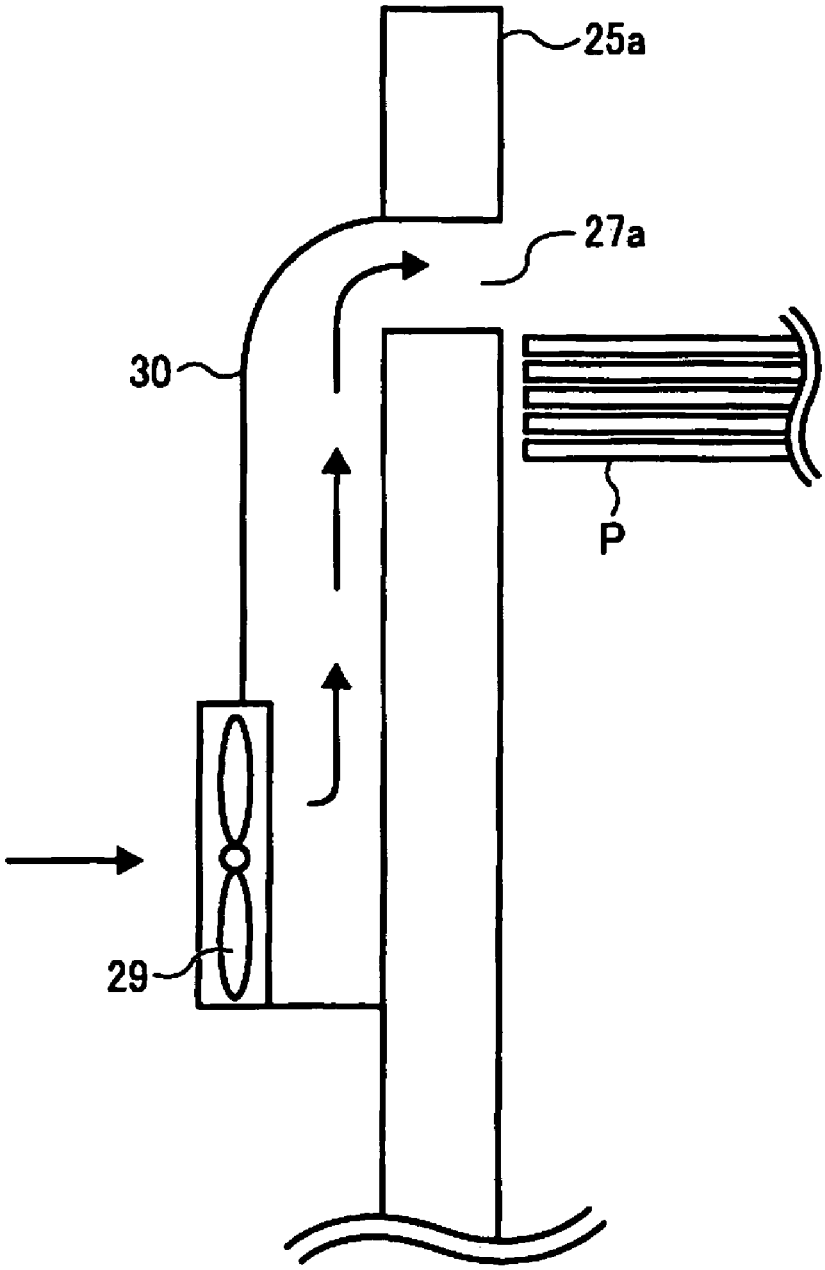
FIG. 3 is a side view of a side fence and an air inlet included in the sheet tray shown in FIG. 2.

FIG. 3 is a side view of the side fence 25*a* and the air inlet 27*a* seen from the end fence 26. The fan 29 is arranged on the outside of the side fence 25*a*. The fan 29 is preferably a blower fan, but can be another type of fans, such as a sirocco fan. The outside air flows, by rotation of the fan 29, upward through a blowing guide 30 to the air inlet 27*a*. The air inlet 27*a* is formed on the side fence 25*a*. The air through the air inlet 27*a* flows from the side of a pile P of sheets stacked on the bottom plate 21. As a result, several sheets in the upper portion of the pile P float in the air, so that the sheets can be separated from one another.

To prevent such a situation that no sheet is fed from the sheet tray or plural sheets are fed from the sheet tray at one time, a blowing operation needs to be performed continuously for a certain period before a feeding operation is performed (hereinafter, such a period is referred to as "blowing time").

Figure 4:
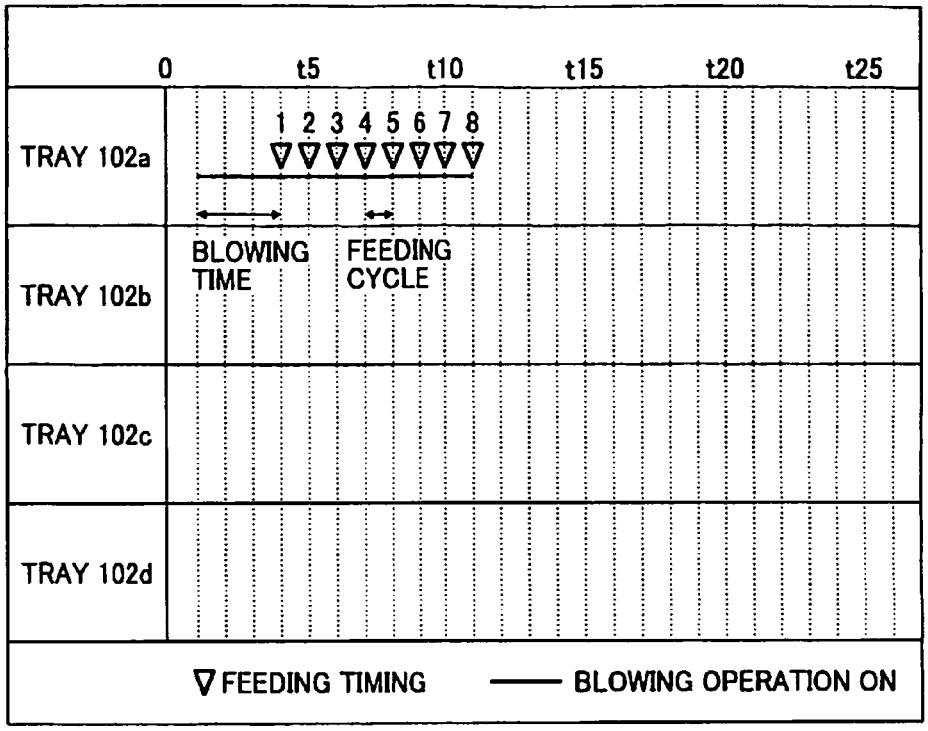
FIG. 4 is a timing chart of an example of a conventional feeding operation in which the sheet feeding device feeds one sheet after another from the same sheet tray.

FIG. 4 is a timing chart of an example of a conventional feeding operation in which the sheet feeding device 102 feeds one sheet after another from the same sheet tray 102*a*. The horizontal axis of the timing chart indicates timing.

The blowing operation for the sheet tray 102*a* starts at timing t1. The blowing time continues from timing t1 to timing t4, so that the sheets are separated from one another. Then, the sheet tray 102*a* feeds the first sheet at timing t4. Afterward, the sheet tray 102*a* feeds the second sheet, the third sheet, the fourth sheet, . . . , and the eighth sheet at timing t5, timing t6, timing t7, and timing t8, respectively. It takes the blowing time to start feeding the first sheet from the sheet tray 102*a*.

Figure 5:
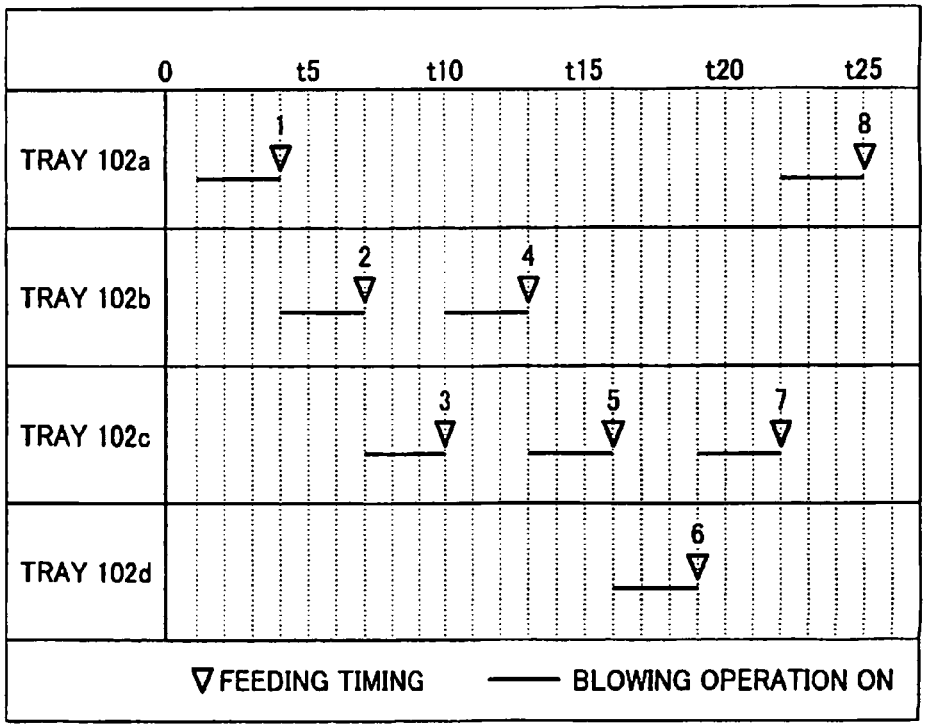
FIG. 5 is a timing chart of another example of the conventional feeding operation in which the sheet feeding device feeds one sheet after another from different sheet trays.

FIG. 5 is a timing chart of another example of the conventional feeding operation in which the sheet feeding device 102 feeds one sheet after another from different sheet trays from among the sheet trays 102*a*, 102*b*, 102*c*, and 102*d*.

The feeding control unit 111 receives an instruction on the next sheet tray from the controller 110 each time before feeding one sheet. Upon receiving the instruction, the feeding control unit 111 starts the blowing operation for the next sheet tray. After a predetermined blowing time elapses, the feeding control unit 111 feeds a sheet from the sheet tray specified base on the instruction.

Specifically, the controller 110 sends an instruction to the feeding control unit 111 at timing t1 to cause the sheet tray 102*a* to feed a sheet. The feeding control unit 111 then starts the blowing operation for the sheet tray 102*a* in response to the instruction. The blowing time continues from timing t1 to timing t4. Then, the sheet tray 102*a* feeds the first sheet at timing t4. The controller 110 sends an instruction to the feeding control unit 111 at timing t4 to switch the current sheet tray from the sheet tray 102*a* to the sheet tray 102*b*.

Upon receiving the instruction from the controller 110, the feeding control unit 111 starts the blowing operation for the sheet tray 102*b* at timing t4. The blowing time continues from timing t4 to timing t7. Then, the sheet tray 102*b* feeds the second sheet at timing t7. The controller 110 sends an instruction to the feeding control unit 111 at timing t7 to switch the current sheet tray from the sheet tray 102*b* to the sheet tray 102*c*.

Upon receiving the instruction from the controller 110, the feeding control unit 111 starts the blowing operation for the sheet tray 102*c* at timing t7. The blowing time continues from timing t7 to timing t10. Then, the sheet tray 102*c* feeds the third sheet at timing t10. Afterward, the switching of the current sheet tray and the blowing operation for the current sheet tray are repeated in the same manner as described above.

Specifically, the sheet tray 102*b* feeds the fourth sheet at timing t13, the sheet tray 102*c* feeds the fifth sheet at timing t16, the sheet tray 102*d* feeds the sixth sheet at timing t19, the sheet tray 102*c* feeds the seventh sheet at timing t22, and the sheet tray 102*a* feeds the eighth sheet at timing t25. Thus, because it takes the blowing time each time the current sheet tray is switched over, the productivity is remarkably decreased.

If the feeding operation is performed by switching over the sheet trays 102*a*, 102*b*, 102*c*, and 102*d*, the easiest way to prevent such decrease in the productivity is to start the blowing operation for all of the sheet trays 102*a*, 102*b*, 102*c*, and 102*d* before the sheet trays are switched over. However, if such an operation is performed, electric-power consumption increases remarkably due to an operation of the fan 29 of each of the sheet trays 102*a*, 102*b*, 102*c*, and 102*d*. Furthermore, in some cases, the electric power is not sufficiently obtained to drive all of the fans 29 of the sheet trays 102*a*, 102*b*, 102*c*, and 102*d* depending on a size of a power circuit (not shown) included in the sheet feeding device 102 or a limited electric power supplied from a commercial power supply. In such a case, because only some of the fans 29 of the sheet trays 102*a*, 102*b*, 102*c*, and 102*d* are driven, the blowing operation cannot always be performed for the next sheet tray.

Figure 6:
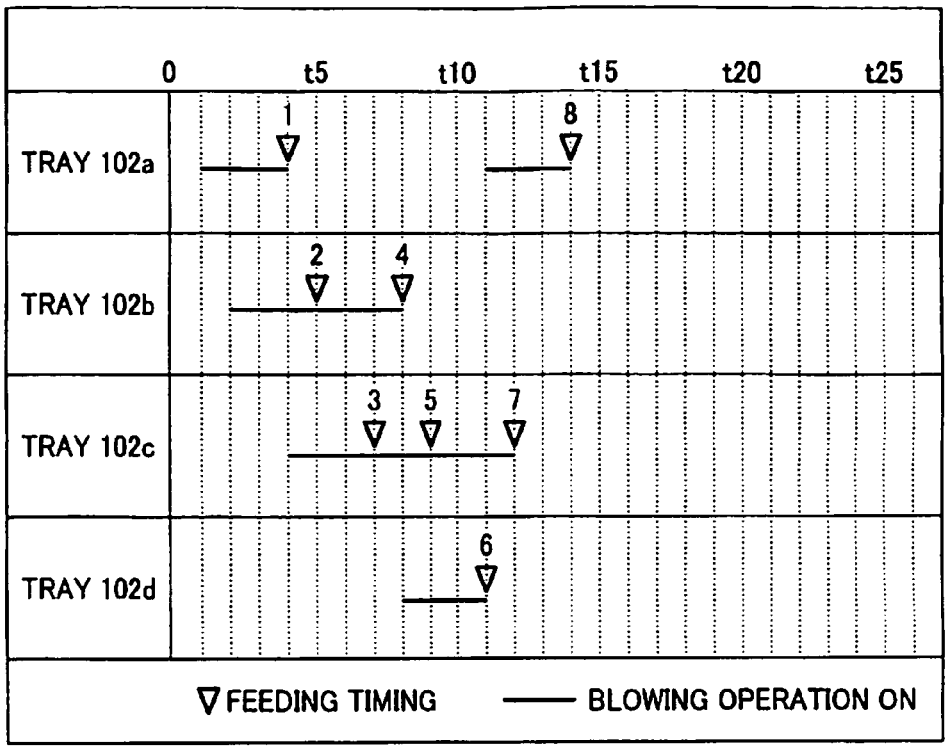
FIG. 6 is a timing chart of a feeding operation and a blowing operation according to a first embodiment of the present invention.

FIG. 6 is a timing chart of a feeding operation and a blowing operation performed by the sheet feeding device 102 according to a first embodiment of the present invention. In this example, the feeding control unit 111 that controls turning on/off of the fan 29 of each of the sheet trays 102*a*, 102*b*, 102*c*, and 102*d* has obtained information from the controller 110 in advance about the order of the sheet trays in which the feeding operation is performed. That is, before the blowing operation is started for the next sheet tray, it is determined to start the blowing operation for the next sheet tray whether the number of sheet trays for performing the blowing operation is equal to or larger than a predetermined number of sheet trays for which the blowing operation is simultaneously performed (hereinafter, "simultaneous operation number"). In the first embodiment, the simultaneous operation number is set to two.

In the first embodiment, the feeding control unit 111 receives an instruction from the controller 110 at timing t0 to timing t1 shown in FIG. 6 to perform the feeding operation in the order of the sheet tray 102*a*, the sheet tray 102*b*, the sheet tray 102*c*, the sheet tray 102*b*, the sheet tray 102*c*, the sheet tray 102*d*, the sheet tray 102*c*, and the sheet tray 102*a*. Furthermore, in the first embodiment, the feeding control unit 111 operates the fans 29 of up to two sheet trays, i.e., the current sheet tray and the next sheet tray.

The feeding control unit 111 starts the blowing operation for the sheet tray 102*a* at timing t1. The blowing operation continues for three units of time from timing t1 to timing t4, and the sheet tray 102*a* feeds the first sheet at timing t4.

The feeding control unit 111 starts the blowing operation for the sheet tray 102*b* at timing t2 in parallel with the blowing operation for the sheet tray 102*a*. It is possible that the blowing operation for the sheet tray 102*b* starts at timing t1. However, if the blowing operation for the sheet tray 102*b* starts at timing t1, because the sheet tray 102*b* feeds the second sheet at timing t5, the blowing operation continues for four units of time from timing t1 to timing t5. This causes an unnecessary increase in the electric power for one unit of time. Therefore, it is preferable that the blowing operation for the sheet tray 102*b* starts at timing t2. The blowing operation for the sheet tray 102*b* continues for three units of time from timing t2 to timing t5, and the sheet tray 102*b* feeds the second sheet at timing t5.

The feeding control unit 111 has received an instruction from the controller 110 to cause the sheet tray 102*c* to feed the third sheet. As described above, because the sheet tray 102*b* feeds the second sheet at timing t5, the earliest timing of feeding the third sheet from the sheet tray 102*c* is timing t6. Because the blowing time continues for three units of time, the blowing operation for the sheet tray 102*c* needs to start at timing t3.

However, the blowing operation for the sheet tray 102*a* and the sheet tray 102*b* is performed at timing t3. Therefore, if the blowing operation for the sheet tray 102*c* is started at timing t3, the blowing operation for the three sheet trays 102*a*, 102*b*, and 102*c* is to be simultaneously performed, and therefore the number of sheet trays for performing the blowing operation exceeds the simultaneous operation number. Therefore, after the sheet tray 102*a* feeds the first sheet at timing t4, the feeding control unit 111 stops the blowing operation for the sheet tray for which the blowing operation has started at the earliest timing from among the trays for which the blowing operation is performed, so that the feeding control unit 111 can start the blowing operation for the sheet tray 102*c*. In this case, the feeding control unit 111 stops the blowing operation for the sheet tray 102*a*.

The feeding control unit 111 starts the blowing operation for the sheet tray 102*c* at the same time the feeding control unit 111 stops the blowing operation for the sheet tray 102*a* at timing t4. Because the blowing operation needs to continue for three units of time from timing t4 to timing t7, the sheet tray 102*c* feeds the third sheet at timing t7.

The feeding control unit 111 has received an instruction from the controller 110 to cause the sheet tray 102*b* to feed the fourth sheet. As described above, because the sheet tray 102*c* feeds the third sheet at timing t7, the earliest timing of feeding the fourth sheet from the sheet tray 102*b* is timing t8. As described above, the sheet tray 102*b* feeds the second sheet at timing t5. The blowing operation for the sheet tray 102*b* and the sheet tray 102*c* are performed in parallel after timing t4, and the number of sheet trays for performing the blowing operation does not exceed the simultaneous operation number. Therefore, the feeding control unit 111 continues the blowing operation for the sheet tray 102*b* after timing t5, and causes the sheet tray 102*b* to feed the fourth sheet at timing t8.

In the same manner, the feeding control unit 111 causes the sheet tray 102*c* to feed the fifth sheet at timing t9.

The feeding control unit 111 has received an instruction from the controller 110 to cause the sheet tray 102*d* to feed the sixth sheet. As described above, because the sheet tray 102*c* feeds the fifth sheet at timing t9, the earliest timing of feeding the sixth sheet from the sheet tray 102*d* is timing t10. Because the blowing time continues for three units of time, the blowing operation for the sheet tray 102*d* needs to start at timing t7.

However, the blowing operation for the sheet tray 102*b* and the sheet tray 102*c* is performed at timing t7. Therefore, if the blowing operation for the sheet tray 102*d* is started at timing t7, the blowing operation for the three sheet trays 102*b*, 102*c*, and 102*d* is to be simultaneously performed. As a result, the number of the sheet trays for performing the blowing operation exceeds the simultaneous operation number. Therefore, after the sheet tray 102*b* feeds the fourth sheet at timing t8, the feeding control unit 111 stops the blowing operation for the sheet tray 102*b*, so that the feeding control unit 111 can start the blowing operation for the sheet tray 102*d*.

The feeding control unit 111 starts the blowing operation for the sheet tray 102*d* at the same time the feeding control unit 111 stops the blowing operation for the sheet tray 102*b* at timing t8. Because the blowing operation needs to continue for three units of time from timing t8 to timing t11, the sheet tray 102*d* feeds the sixth sheet at timing t11.

Then, the feeding control unit 111 causes the sheet tray 102*c* to feed the seventh sheet at timing t12 in the same manner as in the feeding operation of the fourth sheet.

The feeding control unit 111 has received an instruction from the controller 110 to cause the sheet tray 102*a* to feed the eighth sheet. As described above, because the sheet tray 102*c* feeds the seventh sheet at timing t12, the earliest timing of feeding the eighth sheet from the sheet tray 102*a* is timing t13. Because the blowing time continues for three units of time, the blowing operation for the sheet tray 102*a* needs to start at timing t10.

However, the blowing operation for the sheet tray 102*c* and the sheet tray 102*d* is performed at timing t10. Therefore, if the blowing operation for the sheet tray 102*a* is started at timing t10, the blowing operation for the three sheet trays 102*a*, 102*c*, and 102*d* are to be simultaneously performed. As a result, the number of the sheet trays for performing the blowing operation exceeds the simultaneous operation number. Therefore, after the sheet tray 102*d* feeds the sixth sheet at timing t11, the feeding control unit 111 stops the blowing operation for the sheet tray 102*d*, so that the feeding control unit 111 can start the blowing operation for the sheet tray 102*a* at timing t11.

The feeding control unit 111 starts the blowing operation for the sheet tray 102*a* at the same time the feeding control unit 111 stops the blowing operation for the sheet tray 102*d* at timing t11. Because the blowing operation needs to continue for three units of time from timing t11 to timing t14, the sheet tray 102*a* feeds the eighth sheet at timing t14.

Then, the feeding operation of the first sheet to the eighth sheet is completed, and the feeding control unit 111 stops the blowing operation for all of the sheet trays 102*a*, 102*b*, 102*c*, and 102*d*.

Generally, if the blowing operation is not performed for a certain time, the sheets are not sufficiently separated from one another. Therefore, in the first embodiment, the blowing time from start of the blowing operation to the feeding operation is set to be three units of time.

As described above, in the first embodiment, the blowing time is set to be three units of time and the simultaneous operation number is set to two for each of the sheet trays 102*a*, 102*b*, 102*c*, and 102*d*. Furthermore, if the number of sheet trays for performing the blowing operation is equal to or larger than the simultaneous operation number, the start timing of the blowing operation for the next sheet tray is delayed so that the number of sheet trays for performing the blowing operation does not exceed the predetermined number.

In this manner, the feeding operation for the current sheet tray can be performed in parallel with the blowing operation for the next sheet tray. With this configuration, when the next sheet tray is switched to the current sheet tray, the current sheet tray can feed a sheet at the earliest timing. Thus, the productivity can be significantly increased. Furthermore, because the number of sheet trays for which the blowing operation is simultaneously performed is limited, the electric-power consumption is reduced.

The simultaneous operation number is not limited to two. The simultaneous operation number can be set to an appropriate number depending on balance between the productivity and the allowable electric-power consumption. The operator of the sheet feeding device 102 can set the simultaneous operation number to any desired number depending on the needs.

In a second embodiment of the present invention, the feeding control unit 111 has no prior information about the next sheet tray from the controller 110. In other words, the feeding control unit 111 receives an instruction on the next sheet tray from the controller 110 each time the current sheet tray feeds a sheet. In such a case, the feeding control unit 111 controls the sheet trays 102*a*, 102*b*, 102*c*, and 102*d* in such a manner to ensure that the blowing operation is performed for the next sheet tray.

For example, if a job is executed by repeating the same operation for a plurality of cycles, the operation is performed in the first cycle in the manner shown in FIG. 5. Specifically, each time the feeding control unit 111 receives an instruction on the next sheet tray from the controller 110, the feeding control unit 111 starts the blowing operation for the next sheet tray. When the predetermined blowing time elapses, the feeding control unit 111 causes that sheet tray to feed a sheet.

In the first cycle, the feeding control unit 111 stores the order of the sheet trays 102*a*, 102*b*, 102*c*, and 102*d* in which the feeding operation is performed. Then, in the second and subsequent cycles, the feeding control unit 111 controls the sheet trays 102*a*, 102*b*, 102*c*, and 102*d* in the manner shown in FIG. 6 based on the stored order. Thus, it is possible to maintain high productivity in the second and subsequent cycles. For example, if a plurality of sets (e.g., five sets or ten sets) of copies is to output from an original containing eight pages, it is effective to control the sheet trays 102*a*, 102*b*, 102*c*, and 102*d* in the manner according to the second embodiment. In such a case, the first set of copies is output in the manner shown in FIG. 5, and the second and subsequent sets of copies are output in the manner shown in FIG. 6.

Figure 7:
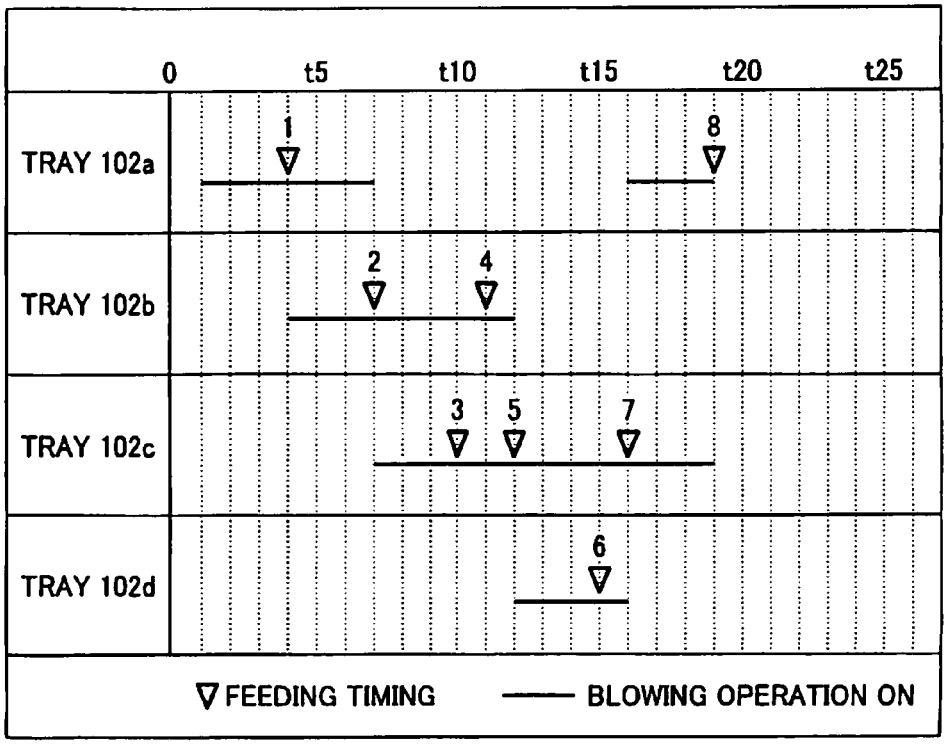
FIG. 7 is a timing chart of a feeding operation and a blowing operation according to a third embodiment of the present invention.

FIG. 7 is a timing chart of a feeding operation and a blowing operation performed by the sheet feeding device 102 according to a third embodiment of the present invention. In the third embodiment, the feeding control unit 111 has no prior information about the next sheet tray from the controller 110. In other words, the feeding control unit 111 receives an instruction on the next sheet tray from the controller 110 each time the current sheet tray feeds a sheet.

Each time the feeding control unit 111 receives an instruction on the next sheet tray from the controller 110, the feeding control unit 111 starts the blowing operation for the next sheet tray. When the predetermined blowing time elapses, the feeding control unit 111 causes the next sheet tray to feed a sheet. In the third embodiment, it is determined whether the number of sheet trays for performing the blowing operation is equal to or larger than the simultaneous operation number at the same time the blowing operation for the next sheet tray is started.

The feeding control unit 111 starts the blowing operation for the sheet tray each time the feeding control unit 111 receives an instruction on the next sheet tray, and if the number of sheet trays in operation reaches the simultaneous operation number, the feeding control unit 111 stops the blowing operation for the sheet tray for which the blowing operation has started at the earliest timing from among the trays for which the blowing operation is performed.

As shown in FIG. 7, the feeding control unit 111 receives an instruction to cause the sheet tray 102*a* to feed the first sheet at timing t1. The feeding control unit 111 starts the blowing operation for the sheet tray 102*a* in response to the instruction. The blowing time continues from timing t1 to timing t4. The sheet tray 102*a* then feeds the first sheet at timing t4. In the third embodiment, because the feeding control unit 111 does not receive an instruction from the controller 110 to turn on/off the fan 29 of each of the sheet trays 102*a*, 102*b*, 102*c*, and 102*d*, the blowing operation for the sheet tray 102*a* continues after timing t4.

The feeding control unit 111 receives an instruction to cause the sheet tray 102*b* to feed the second sheet at the same time the sheet tray 102*a* feeds the first sheet at timing t4. Because the blowing operation is performed for only the sheet tray 102*a* at timing t4, the number of sheet trays for performing the blowing operation does not reach the simultaneous operation number. Therefore, the feeding control unit 111 starts the blowing operation for the sheet tray 102*b* in parallel with the blowing operation for the sheet tray 102*a*. The blowing time continues from timing t4 to timing t7. The sheet tray 102*b* then feeds the second sheet at timing t7. The blowing operation for the sheet tray 102*b* continues after timing t7.

The feeding control unit 111 receives an instruction to cause the sheet tray 102*c* to feed the third sheet at the same time the sheet tray 102*b* feeds the second sheet at timing t7. The blowing operation is performed for the sheet tray 102*a* and the sheet tray 102*b* at timing t7. Because the number of sheet trays for performing the blowing operation reaches the simultaneous operation number, the feeding control unit 111 stops the blowing operation for the sheet tray 102*a* for which the blowing operation has started at an earlier timing than it has for the sheet tray 102*b*. Thus, the number of sheet trays for performing the blowing operation does not reach the simultaneous operation number, and therefore the feeding control unit 111 can start the blowing operation for the sheet tray 102*c*.

The blowing time for the sheet tray 102*c* continues from timing t7 to timing t10. The sheet tray 102*c* then feeds the third sheet at timing t10.

The feeding control unit 111 receives an instruction to cause the sheet tray 102*b* to feed the fourth sheet at the same time the sheet tray 102*c* feeds the third sheet at timing t10. Because the blowing operation for the sheet tray 102*b* continues at timing t10, the earliest timing of feeding the fourth sheet from the sheet tray 102*b* is timing t11. Therefore, the feeding control unit 111 continues the blowing operation for the sheet tray 102*b*, and causes the sheet tray 102*b* to feed the fourth sheet at timing t11. The blowing operation for the sheet tray 102*b* continues after timing t11.

The feeding control unit 111 receives an instruction to cause the sheet tray 102*c* to feed the fifth sheet at timing t11. Because the blowing operation for the sheet tray 102*c* continues at timing t11, the earliest timing of feeding the fifth sheet from the sheet tray 102*c* is timing t12. Therefore, the feeding control unit 111 continues the blowing operation for the sheet tray 102*c*, and causes the sheet tray 102*c* to feed the fifth sheet at timing t12.

The feeding control unit 111 receives an instruction to cause the sheet tray 102*d* to feed the sixth sheet at the same time the sheet tray 102*c* feeds the fifth sheet at timing t12. The blowing operation is performed for the sheet tray 102*b* and the sheet tray 102*c* at timing t12. Because the number of sheet trays for performing the blowing operation reaches the simultaneous operation number, the feeding control unit 111 stops the blowing operation for the sheet tray 102*b* for which the blowing operation has started at an earlier timing than it has for the sheet tray 102*c*. Thus, the number of sheet trays for performing the blowing operation does not reach the simultaneous operation number, and therefore the feeding control unit 111 can start the blowing operation for the sheet tray 102*d*.

The blowing time for the sheet tray 102*d* continues from timing t12 to timing t15. The sheet tray 102*d* then feeds the sixth sheet at timing t15. The blowing operation for the sheet tray 102*d* continues after timing t15.

The feeding control unit 111 receives an instruction to cause the sheet tray 102*c* to feed the seventh sheet at timing t15. Because the blowing operation for the sheet tray 102*c* continues at timing t15, the earliest timing of feeding the seventh sheet from the sheet tray 102*c* is timing t16. Therefore, the feeding control unit 111 continues the blowing operation for the sheet tray 102*c*, and causes the sheet tray 102*c* to feed the seventh sheet at timing t16. The blowing operation for the sheet tray 102*c* continues after timing t16.

The feeding control unit 111 receives an instruction to cause the sheet tray 102*a* to feed the eighth sheet at the same time the sheet tray 102*c* feeds the seventh sheet at timing t16. The blowing operation is performed for the sheet tray 102*c* and the sheet tray 102*d* at timing t16. Because the number of sheet trays for performing the blowing operation reaches the simultaneous operation number, the feeding control unit 111 stops the blowing operation for the sheet tray 102*d*. Thus, the number of sheet trays for performing the blowing operation does not reach the simultaneous operation number, and therefore the feeding control unit 111 can start the blowing operation for the sheet tray 102*a*.

The blowing time for the sheet tray 102*a* continues from timing t16 to timing t19. The sheet tray 102*a* then feeds the eighth sheet at timing t19. Thus, the feeding operation of the first sheet to the eighth sheet is completed, and the feeding control unit 111 stops the blowing operation for the sheet tray 102*a* and the sheet tray 102*c*.

As described above, in the third embodiment, if the number of sheet trays for performing the blowing operation is equal to or larger than the simultaneous operation number, the blowing operation for any one of the sheet trays for which the blowing operation is currently performed is stopped, so that the number of sheet trays for performing the blowing operation does not exceed the simultaneous operation number.

In the third embodiment, even though the sheet feeding device 102 receives an instruction on the next sheet tray each time the current sheet tray feeds a sheet, it is possible to improve the productivity. Although it is explained above that the feeding control unit 111 receives an instruction on the sheet tray from which the n-th (n is an integer number) sheet is fed at the same time the (n−1)-th sheet is fed, it is allowable to receive the instruction at different timing.

After the air is blown to the pile to separate the sheets, the adhesion between the sheets is decreased, and the sheets are maintained in such a condition for a while. Therefore, when the next blowing operation is performed on the sheets in that condition, the blowing time can be shortened and an air volume can be lowered. For this reason, in a fourth embodiment of the present invention, if the blowing operation has been performed for the sheet tray, the blowing time for the sheet tray is shortened at the next blowing operation.

Figure 8:
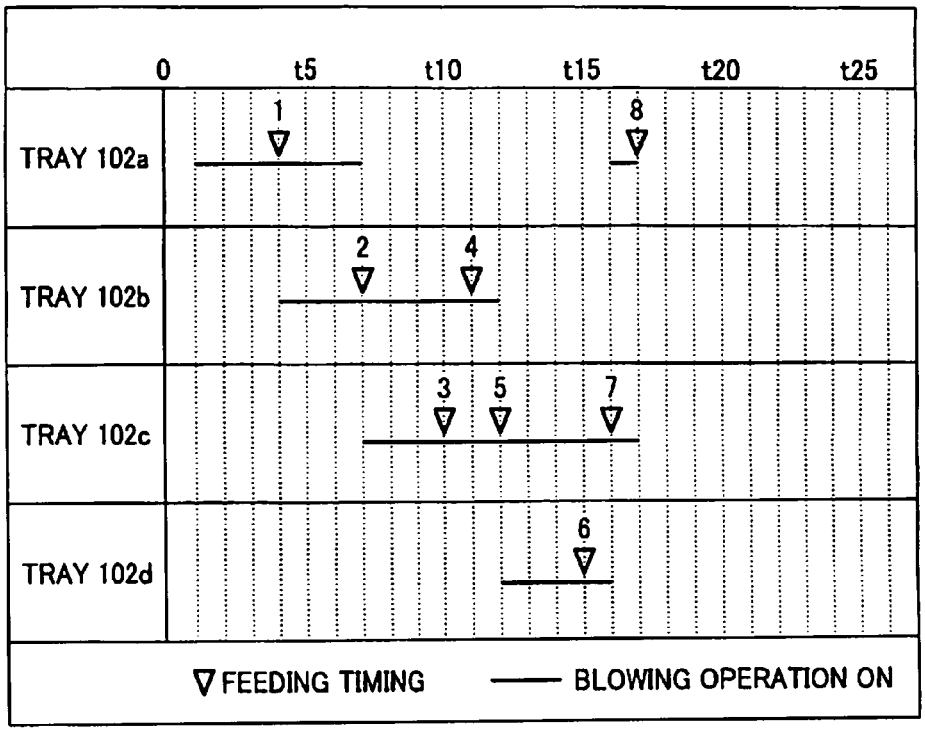
FIG. 8 is a timing chart of a feeding operation and a blowing operation according to a fourth embodiment of the present invention.

FIG. 8 is a timing chart of a feeding operation and a blowing operation performed by the sheet feeding device 102 according to the fourth embodiment. The same operation as in the third embodiment is performed in the fourth embodiment until the sheet tray 102*c* feeds the seventh sheet at timing t16, and therefore explanation of the same part is omitted.

The feeding control unit 111 receives an instruction to cause the sheet tray 102*a* to feed the eighth sheet at the same time the sheet tray 102*c* feeds the seventh sheet at timing t16. The blowing operation has been performed for the sheet tray 102*a* from timing t1 to timing t7, and the sheets in the sheet tray 102*a* has been separated by the air from one another at the blowing time. Therefore, the sheets can be sufficiently separated without performing the blowing operation for three units of time from timing t16 to timing t19.

Therefore, the blowing time that starts for the sheet tray 102*a* at timing t16 is shortened. That is, the blowing time for the sheet tray 102*a* continues for one unit of time from timing t16 to timing t17. As a result, compared to the feeding operation in the third embodiment as shown in FIG. 7 in which the feeding operation of the eighth sheet is completed at timing t19, the feeding operation of the eighth sheet is completed at timing t17 in the fourth embodiment.

As described above, in the fourth embodiment, a blowing time at a blowing operation for a sheet tray for which the blowing operation has been performed before is reduced. Thus, it is possible to improve the productivity.

As described in the fourth embodiment, after the air is blown to the pile to separate the sheets, the adhesion between the sheets is decreased, and the sheets are maintained in such a condition for a while. Therefore, in a fifth embodiment of the present invention, a volume of air for the sheet tray is reduced after the blowing operation and the feeding operation are performed.

Figure 9:
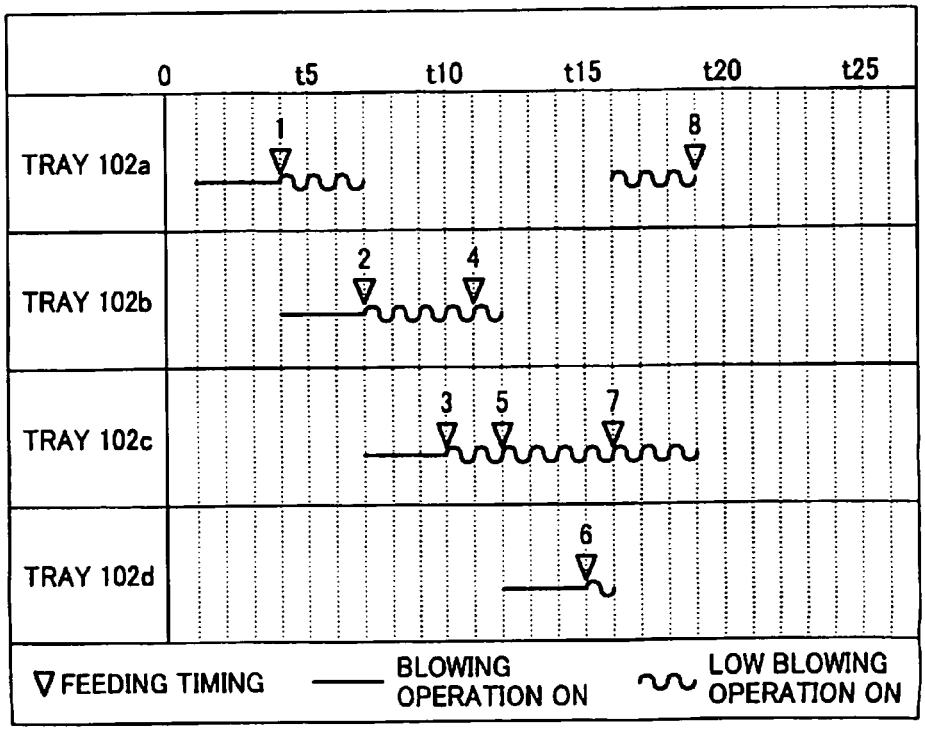
FIG. 9 is a timing chart of a feeding operation and a blowing operation according to a fifth embodiment of the present invention.

FIG. 9 is a timing chart of a feeding operation and a blowing operation performed by the sheet feeding device 102 according to the fifth embodiment. The overall operation in the fifth embodiment is the same as that in the third embodiment, and therefore explanation of the same part is omitted. In the fifth embodiment, after the blowing operation and the feeding operation are performed for the sheet tray, the blowing operation is continued for the sheet tray with a lower air volume.

The blowing operation is performed with a lower air volume for the sheet tray 102*a* from timing t4 to timing t7, for the sheet tray 102*b* from timing t7 to timing t12, for the sheet tray

102*c* from timing t10 to timing t19, and for the sheet tray 102*d* from timing t15 to timing t16.

In the fifth embodiment, the blowing operation is continued with a lower air volume after the feeding operation is performed. Thus, it is possible to save the electric power.

As described in the fourth embodiment, after the air is blown to the pile to separate the sheets, the adhesion between the sheets is decreased, and the sheets are maintained in such a condition for a while. Therefore, in a sixth embodiment of the present invention, both a volume of air and a blowing time at a blowing operation for a sheet tray for which the blowing operation has been performed before are reduced.

Figure 10:
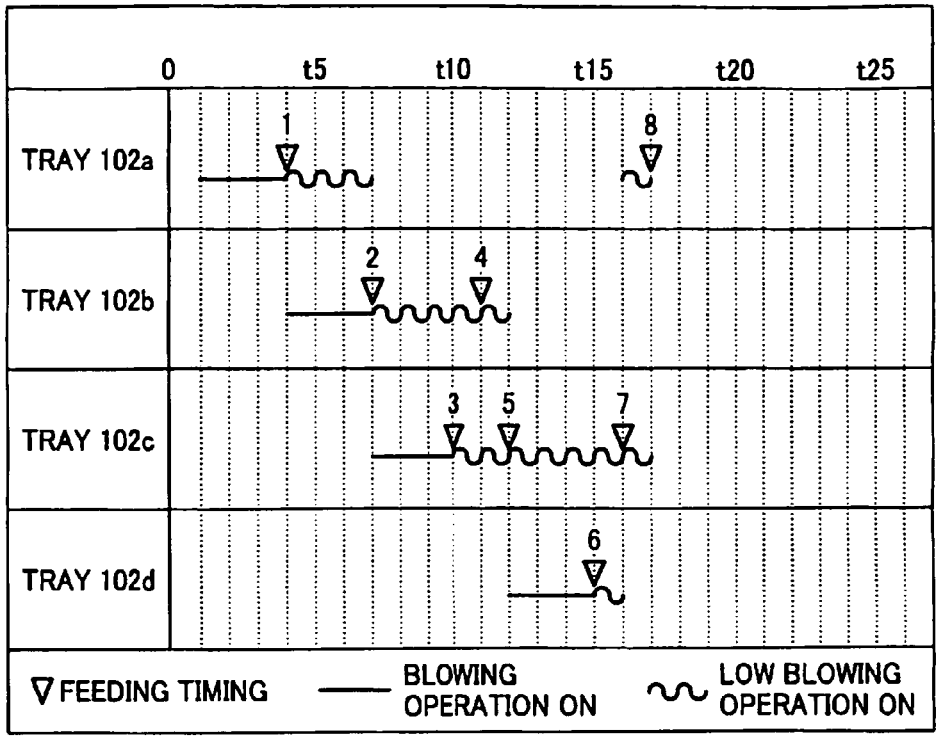
FIG. 10 is a timing chart of a feeding operation and a blowing operation according to a sixth embodiment of the present invention.

FIG. 10 is a timing chart of a feeding operation and a blowing operation performed by the sheet feeding device 102 according to the sixth embodiment. The overall operation timing in the sixth embodiment is the same as that in the fourth embodiment, and therefore explanation of the same part is omitted. In the same manner as in the fifth embodiment, the blowing operation is performed with a lower air volume for the sheet tray 102*a* from timing t4 to timing t7, for the sheet tray 102*b* from timing t7 to timing t12, for the sheet tray 102*c* from timing t10 to timing t17, and for the sheet tray 102*d* from timing t15 to timing t16. Thus, it is possible to improve the productivity while saving the electric power.

To sufficiently separate the sheets, after the blowing operation is performed with a lower air volume, a level of the air volume is increased to the normal level for one unit of time immediately before the feeding operation is performed. Specifically, in FIG. 10, a level of the air volume is increased to the normal level for the sheet tray 102*a* from timing t16 to timing t17, for the sheet tray 102*b* from timing t10 to timing t11, for the sheet tray 102*c* from timing t11 to timing t12, and for the sheet tray 102*c* from timing t15 to timing t16. With this configuration, although the electric-power consumption increases slightly, it is possible to save the electric power to a certain degree and to sufficiently separate the sheets. Furthermore, the operation of returning a level of the air volume to the normal level for one unit of time before the feeding operation can be applied to the fifth embodiment.

Although it is explained in the above embodiments that the feeding control unit 111 is included in the image forming apparatus 101, the feeding control unit 111 can be included in the sheet feeding device 102.

According to an aspect of the present invention, it is possible to improve the productivity of the sheet feeding device while reducing the electric-power consumption.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A method of feeding a recording medium to an image forming apparatus by a feeding device that includes a plurality of blowing units each having a fan configured to blow air, the plurality of blowing units configured to blow air to stacks of recording media and a plurality of trays configured to contain the stacks of recording media, the method comprising:

starting, in parallel with a first blowing operation for a first tray as a current feeding tray used in a feeding operation, a second blowing operation for a second tray that is used after the first tray in the feeding operation switching the current feeding tray from the first tray to the second tray when a time elapses after the start of the second blowing operation for the second tray;

feeding the recording medium from the second tray after switching the current feeding tray;

determining whether the number of trays for which blowing operations are being performed is equal to or larger than a predetermined number when the blowing operations are performed for a number of trays including the first tray before starting the second blowing operation for the second tray; and controlling the blowing operations based on a result of the determination.

2. The method according to claim 1, wherein when the number of trays for which the blowing operation is being performed is determined to be equal to or larger than the predetermined number, the limiting controlling includes limiting the number of trays for performing the blowing operation.

3. The method according to claim 1, wherein when the number of trays for which the blowing operation is being performed is determined to be equal to or larger than the predetermined number, the controlling includes adjusting a timing of starting the second blowing operation for the second tray.

4. The method according to claim 1, wherein when the number of trays for which the blowing operation is being performed is determined to be equal to or larger than the predetermined number, the controlling includes stopping a blowing operation for an arbitrary tray from among the trays for which the blowing operation is being performed.

5. The method according to claim 4, wherein the arbitrary tray is a tray for which the blowing operation has been started earliest.

6. The method according to claim 1, wherein when the number of trays for which the blowing operation is being performed is determined to be equal to or larger than the predetermined number, the controlling includes reducing a volume of air at a blowing operation for a tray for which the blowing operation has been performed in a predetermined period before.

7. The method according to claim 1, wherein when the number of trays for which the blowing operation is being performed is determined to be equal to or larger than the predetermined number, the controlling includes reducing a blowing time at a blowing operation for a tray for which the blowing operation has been performed in a predetermined period before.

8. The method according to claim 1, wherein when the number of trays for which the blowing operation is being performed is determined to be equal to or larger than the predetermined number, the controlling includes reducing a volume of air and a blowing time at a blowing operation for a tray for which the blowing operation has been performed in a predetermined period before.

9. The method according to claim 1, further comprising:

storing, when performing a recurrence job in which a same operation is performed repeatedly, an order of switching the trays in a first-cycle operation; and determining the next feeding tray based on the order stored at the storing.

10. A device for feeding a recording medium to an image forming apparatus, the device comprising:

a plurality of blowing units each having a fan configured to blow air, the plurality of blowing units configured to blow air to stacks of recording media;

a plurality of trays each configured to contain the stacks of recording media;

a starting unit configured to start, in parallel with a first blowing operation for a first tray that is a current feeding tray currently performing a feeding operation, a second blowing operation for a second tray that is a next feeding tray to perform the feeding operation next to the first tray;

a plurality of feeding units configured to feed the recording medium from at least the first tray and the second tray, respectively; and a control unit configured to switch the current feeding tray from the first tray to the second tray when a predetermined time elapses after starting the blowing operation for the second tray, determine whether the number of trays for which the blowing operations are being performed is equal to or larger than a predetermined number when the blowing operations are performed for a number of trays including the first tray before starting the second blowing operation for the second tray, and control blowing operations based on a result of determination.

11. The device according to claim 10, wherein when the number of trays for which the blowing operation is being performed is determined to be equal to or larger than the predetermined number, the control unit limits the number of trays for performing the blowing operation.

12. The device according to claim 10, wherein when the number of trays for which the blowing operation is being performed is determined to be equal to or larger than the predetermined number, the control unit adjusts a timing of starting the second blowing operation for the second tray.

13. The device according to claim 10, wherein when the number of trays for which the blowing operation is being performed is determined to be equal to or larger than the predetermined number, the control unit stops a blowing operation for an arbitrary tray from among the trays for which the blowing operation is being performed.

14. An image forming system comprising:

an image forming apparatus that forms an image on a recording medium; and a feeding device that feeds the recording medium to the image forming apparatus, the feeding device including a plurality of blowing units each having a fan configured to blow air, the plurality of blowing units configured to blow air to stacks of recording media, a plurality of trays each configured to contain the stacks of recording media, a starting unit that starts, in parallel with a blowing operation for a first tray that is a current feeding tray currently performing a feeding operation, a second blowing operation for a second tray that is a next feeding tray to perform the feeding operation next to the first tray, a plurality of feeding units that feeds the recording medium from at least the first tray and the second tray, respectively, and a control unit configured to switch the current feeding tray from the first tray to the second tray, determine whether the number of trays for which the blowing operations are being performed is equal to or larger than a predetermined number when the blowing operations are performed for a number of trays including the first tray before starting the second blowing operation for the second tray, and blowing operations based on a result of determination.

15. The image forming system according to claim 14, wherein when the number of trays for which the blowing operation is being performed is determined to be equal to or larger than the predetermined number, the control unit limits the number of trays for performing the blowing operation.

16. The image forming system according to claim 14, wherein when the number of trays for which the blowing operation is being performed is determined to be equal to or larger than the predetermined number, the control unit adjusts a timing of starting the second blowing operation for the second tray.

17. The image forming system according to claim 14, wherein when the number of trays for which the blowing operation is being performed is determined to be equal to or larger than the predetermined number, the control unit stops a blowing operation for an arbitrary tray from among the trays for which the blowing operation is being performed.

* * * * *